US005557249A

United States Patent [19]

Reynal

[11] Patent Number: 5,557,249

[45] Date of Patent: Sep. 17, 1996

[54] LOAD BALANCING TRANSFORMER

[76] Inventor: Thomas J. Reynal, 1127 Ivy Wall, Houston, Tex. 77079

[21] Appl. No.: 292,053

[22] Filed: Aug. 16, 1994

[51] Int. Cl.[6] ..... H01F 30/12

[52] U.S. Cl. ..... 336/5; 336/5; 336/10; 336/12

[58] Field of Search ..... 336/5, 145, 147, 336/173, 180, 182, 183, 184, 220, 221, 222, 225, 12, 10; 323/215, 253, 307; 363/64; 307/13, 14, 17, 36, 37

[56] References Cited

U.S. PATENT DOCUMENTS

| | | | |
|---|---|---|---|
| 4,335,423 | 6/1982 | Koisumi et al. | 363/21 |
| 4,847,745 | 7/1989 | Shekhawat et al. | 363/132 |
| 5,057,808 | 10/1991 | Dhyanchand | 336/12 |
| 5,079,499 | 1/1992 | Owen | 323/361 |
| 5,422,620 | 6/1995 | Bitterli | 336/211 |

*Primary Examiner*—Brian W. Brown
*Assistant Examiner*—G. R. Lord
*Attorney, Agent, or Firm*—Pravel, Hewitt, Kimball & Krieger

[57] ABSTRACT

A three phase transformer having a pair of additional coupled windings on the secondary side of each phase, with these coupled windings properly connected in series to develop a voltage in phase with a particular secondary voltage but driven from alternate phase primaries. The primary and secondary windings are connected in a Y or Δ configuration. One coupled winding from each of the two phases, other than the desired secondary phase which is to be balanced, are joined in negative series so that when summed, they are aligned with the secondary phase being corrected. The series coupled windings are connected in parallel with the third secondary. The unbalanced current is split between the secondary winding and between the two coupled windings, each of which is coupled to the primary of another phase. The coupled winding combined voltages and resistances are approximately equal to the voltage and resistance of the secondary. The transformer design also reduces harmonics of the loaded phase by similarly transferring these harmonics to the other two phases based on the coupled windings.

18 Claims, 5 Drawing Sheets

PRIMARY

PRIMARY

SECONDARY & COUPLED

LOAD BALANCING TRANSFORMER

BACKGROUND OF THE INVENTION

1. Field of the Invention

The invention relates to multi-phase transformer design and more particularly to a three phase transformer arrangement which includes multiple secondary coils to allow balancing of the primary currents when unbalanced loads are present.

2. Description of the Related Art

Electrical power distribution and transmission have a number of problems. This is particularly true when three-phase distribution is being performed. As many simple loads are single phase loads, it then becomes necessary to balance the loads in a three phase system so that one particular phase is not overloaded. The overloading can require additional transformer sizing, wire sizing and so on to handle the additional currents, and can be destructive to the various equipment if not properly sized. If properly sized to handle the imbalance, this results in more expensive components and unused capacity in the lightly loaded phases.

So while load balancing is highly desirable, in many cases this is very difficult to perform. For instance, in a distribution system loads are commonly switched on and off, so that while under maximum load conditions a balanced or near balanced condition could be present, under less than full load conditions where certain loads are on and certain loads are off, an imbalance can readily develop. As this imbalance develops, then of course the primary currents are unbalanced and this trickles up through the entire system, causing problems.

Various attempts have been made to develop systems to automatically balance the loads but in most cases this required an active component of some sort. The most common way is to perform tap changing under load, where the turns ratio of the transformer is changed, changing the voltage of a phase and hence its current. Of course this greatly complicates transformer designs and requires the mechanical mechanisms needed to actually set new taps. As a result, the durability of the device is reduced, maintenance requirements are increased and cost is dramatically increased. Various electronic means have been tried but these are not readily acceptable in a power distribution environment, only for small loads. Further, the electronics adds additional costs and maintenance requirements.

Thus the current solutions have many drawbacks. It is desirable to have a simple passive transformer design wherein load balancing is achieved without the use the any active components such as tap changers or electronics, and without unduly increasing the cost and complexity of the transformer.

SUMMARY OF THE INVENTION

The present invention utilizes a transformer, preferably a three phase transformer or three single phase transformers, having a pair of additional coupled windings on the secondary side of each phase, with these coupled windings properly connected in series to develop a voltage in phase with a particular secondary voltage but driven from alternate phase primaries. Each of the three phases includes a primary winding, a secondary winding, and two coupled windings. The coupled windings have approximately the same number of turns and half the resistance of the secondary winding so that when two coupled windings are connected in series, the voltage is approximately equal to that of the secondary winding and the current is split equally between the two coupled windings and the secondary winding. The primary windings can be connected in Y or Δ configurations as conventional, as can the secondary windings. One coupled winding from each of the two phases, other than the desired secondary phase which is to be balanced, are joined in negative series so that when summed, they are aligned with the secondary phase being corrected.

Should an unbalanced load develop, the additional or unbalanced current is split between the secondary winding and between the two coupled windings, each of which is coupled to the primary of another phase. In this manner, as the load becomes unbalanced, a portion of the imbalance is transferred to the other phases. By doing this, the primary currents are more balanced.

It has been determined that it is desirable to have the combined voltages of the coupled windings approximately equal to or slightly greater than the voltage of the secondary and to have nearly equal impedances of the coupled windings in series and the secondary winding so that the best load balancing is developed. Experimental results have shown that 25 to 33% of the imbalanced load on the most heavily loaded phase can be transferred to the two more lightly loaded phases.

In addition, it has also been determined that the transformer design reduces harmonics of the loaded phase by similarly transferring these harmonics to the other two phases based on the coupled windings. Therefore not only loads are balanced but harmonics are also balanced between the phases to reduce the harmonic levels of the affected phase.

The load balancing is done simply by the proper winding of the phases of the transformer or transformers so that a static transformer is developed without requiring any tap changing apparatus or electronics. Additionally, numerous windings are not added so that the complexity does not become unduly burdensome. This results in a transformer design which provides the desired load balancing characteristics, is entirely passive, and yet is not sufficiently complicated to overly increase the cost.

BRIEF DESCRIPTION OF THE DRAWINGS

A better understanding of the present invention can be obtained when the following detailed description of the preferred embodiment is considered in conjunction with the following drawings in which.

DETAILED DESCRIPTION OF THE PREFERRED EMBODIMENT

Figure 1:
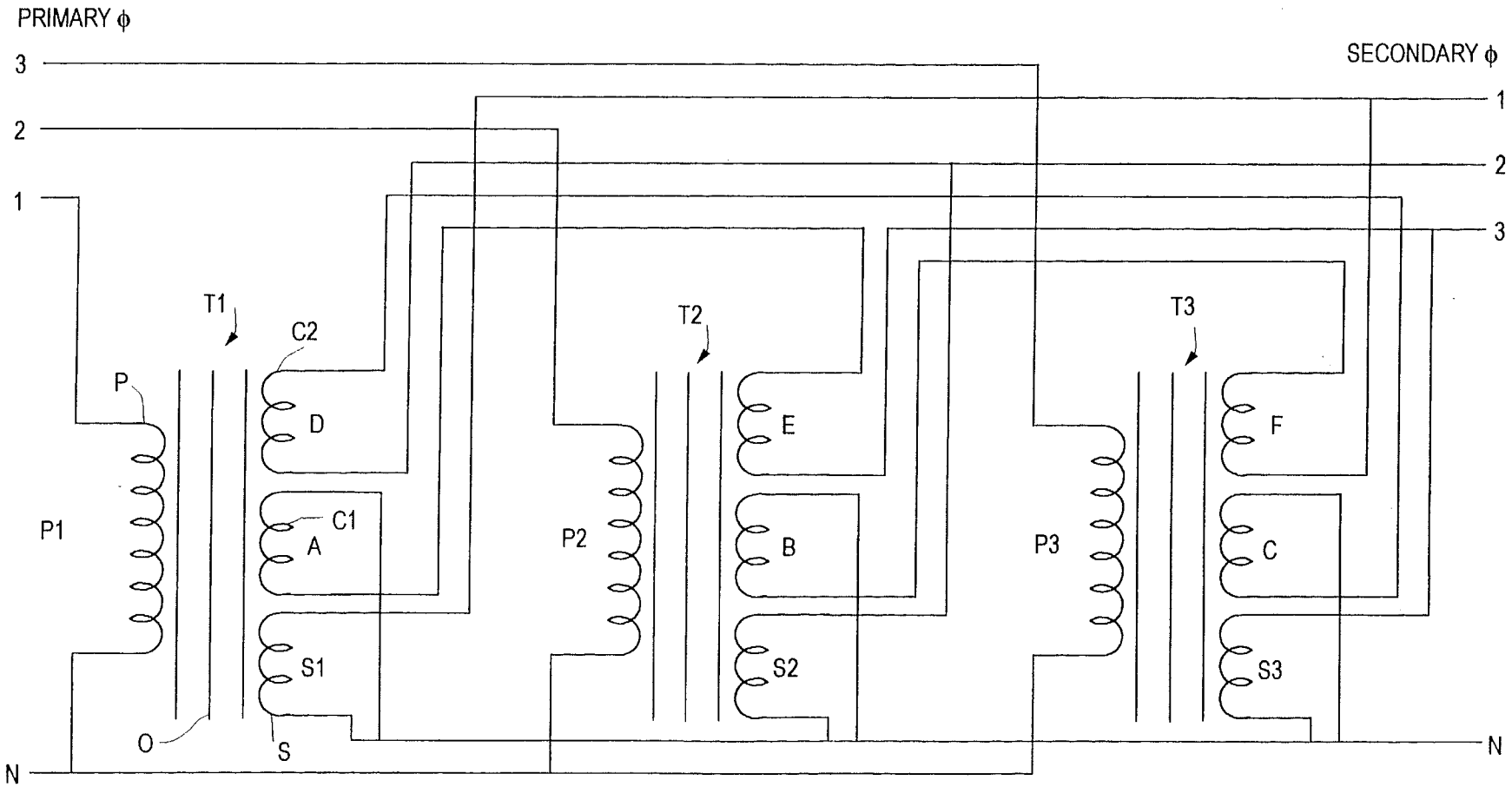
FIG. 1 is a schematic diagram of a three phase transformer arrangement according to the present invention in a Y primary and secondary configuration.

Proceeding now to FIG. 1, a three phase step down transformer arrangement according to the present invention is illustrated. The three phase transformer is composed of individual single phase transformers T1, T2 and T3. It is noted that they are illustrated as being single transformers, but it is understood that a single three phase transformer in a single housing and wound using a three legged core could be used. Each transformer T1, T2, and T3, includes a primary winding P, a secondary winding S, first and second coupled windings C1 and C2 and a transformer core O. The primary winding P is connected between the desired primary phase and the primary neutral, as the illustrated embodiment utilizes a Y connection. Similarly, the secondary winding S is connected between the secondary neutral and the related secondary phase. The coupled windings C1 and C2 each preferably have approximately the same number of turns as the secondary winding S. Having this turns ratio, the voltage developed at the coupled windings C1 and C2 is approximately equal to that of the secondary windings, so that when properly combined in series, the resulting vector voltage is equal to or slightly greater than that of the secondary winding S.

For simplicity of illustration, the primary windings of the transformers T1, T2 and T3 are referred to as P1, P2 and P3 and the secondary windings are S1, S2 and S3. The coupled windings C1 and C2 of transformer T1 are referred to as windings A and D, while the coupled windings Cl and C2 of the transfer T2 are referred to as windings B and E, and the coupled windings C1 and C2 of the transformer T3 are referred to as windings C and F. Thus the primary windings P1, P2 and P3 have one side terminal connected to the primary neutral line N and the other side respectively connected to the primary phases 1, 2 and 3. Similarly, the secondary windings S1, S2 and S3 have one terminal connected to the secondary neutral line and have their second terminal developing the secondary phases 1, 2 and 3, respectively. In addition to these windings, the F and B windings are also connected between the secondary neutral N and secondary phase 1. They are connected in an inverted or negative relationship so that the voltage developed in the secondary phase 1 is –F–B. Similarly, the D and C windings are connected in series and in negative between secondary phase 2 and secondary neutral N and windings E and A are connected in negative and in series between secondary phase 3 and the secondary neutral N.

Figure 2A:
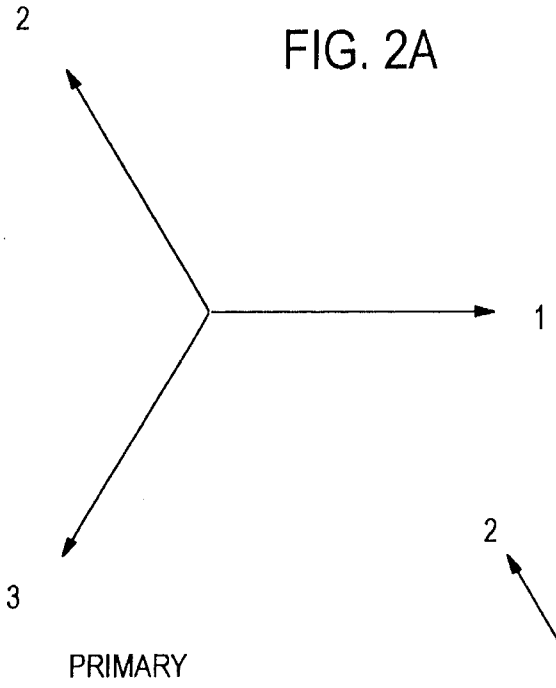
FIGS. 2A, 2B and 2C are vector diagrams of the transformers of FIG. 1.
Figure 2B:
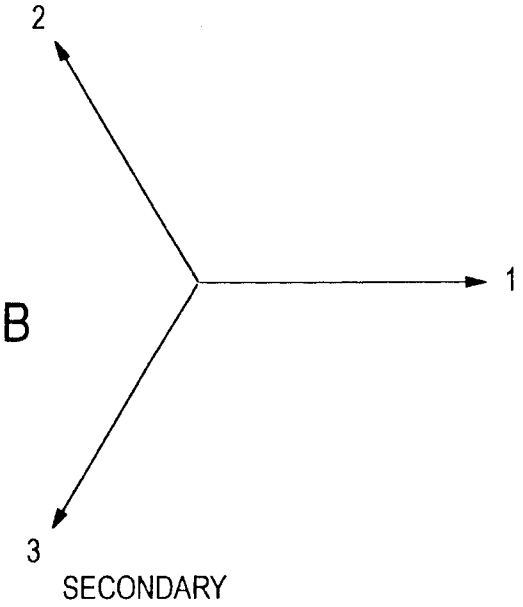

Referring then to FIG. 2A, this a vector illustration of the phases of the primaries of the transformers T1, T2 and T3, indicating the three phase relationship. FIG. 2B then illustrates the relationship of the secondary phases 1, 2 and 3, showing a similar relationship. These are the voltages or currents produced by the secondary windings S1, S2 and S3 from their respective primary windings P1, P2 and P3. The phases of FIGS. 2A and 2B are shown having a similar length, but this is for representative purposes, it being understood that in the preferred embodiment the transformers T1, T2 and T3 are step down transformers and the voltages and currents have different magnitudes between the primary and the secondary sides.

Figure 2C:
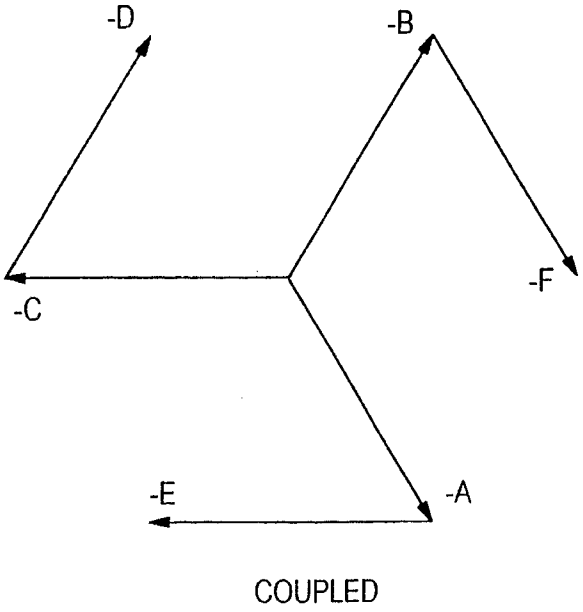

Referring then to FIG. 2C, the vector diagram of the series-linked, coupled windings C1 and C2 is illustrated. For example, the negative series combination of windings B and F is shown as two vectors with the vector –B starting at the origin and the vector –F starting at the end of the vector –B. Similar illustrations are made for the vectors –C and –D and –A and –E. It can be noted that the combination of vectors –B and –F is in phase with the secondary phase 1. Similarly, the combination of vectors –C and –D is in phase with the secondary phase 2 and vectors –A and –E is in phase with secondary phase 3.

Referring back to FIG. 1, coupled windings from transformers T2 and T3, namely windings B and F, are utilized to develop the vectors –F and –B, and are connected in parallel with the secondary winding S1 of transformer T1. This is important as transformers T2 and T3 are connected to primary phases 2 and 3, so that should load be developed and energy drawn from windings B and F, this load is reflected into the primary phrases 2 and 3, not the primary phases 1, thus developing a load balancing situation as the secondary load for phase 1 is then split between secondary S1 and the windings B and F because of their parallel nature. Similar operation results for secondary phases 2 and 3 due to the connections of the windings A, C, D and E.

Figure 3C:
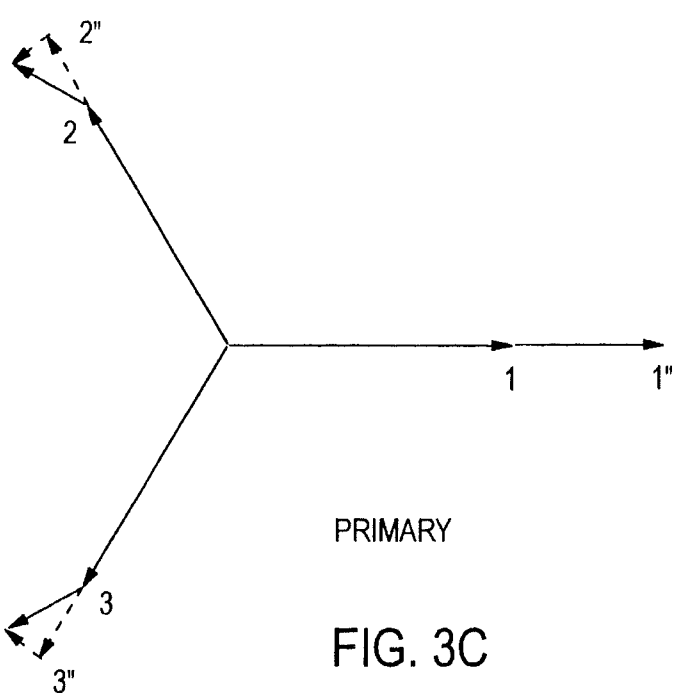
FIGS. 3A, 3B and 3C are vector diagrams illustrating the operation of the transformers of FIG. 1 and prior art transformers under unbalanced load conditions.
Figure 3B:
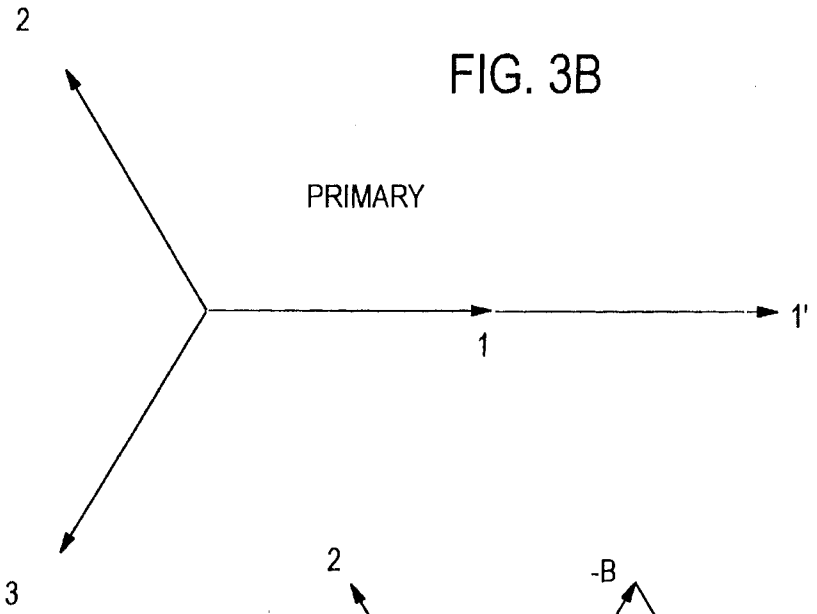
Figure 3A:
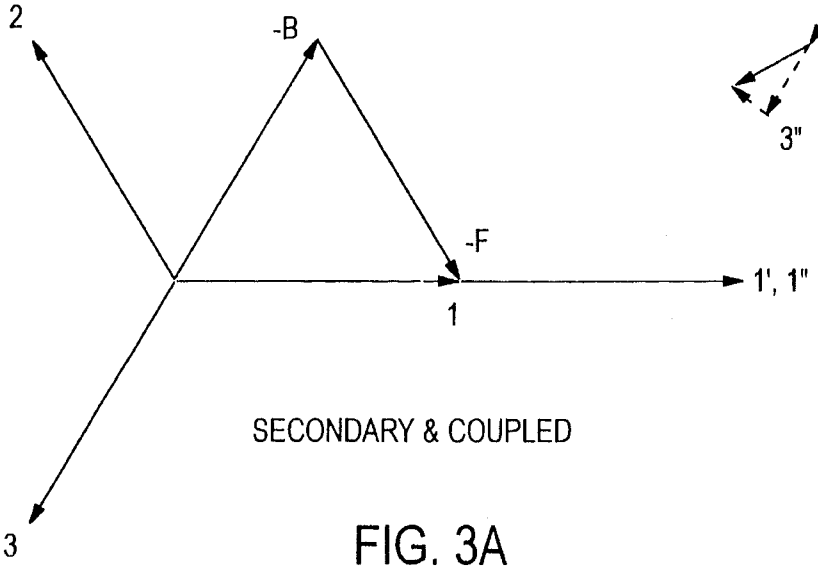

Referring then to FIG. 3A, an unbalanced load vector diagram is illustrated. The reference numerals 1, 2 and 3 indicate a balanced condition while the reference numeral 1' indicates that secondary phase 1 has an unbalanced and greater load. In a conventional transformer arrangement having only primary and secondary windings and no coupled windings, the resultant primary vector diagram would be as illustrated in FIG. 3B, where a greater load is being provided by the primary phase 1 as indicated by the vector 1'. However, it is noted in FIG. 3A that the –B, –F vector developed by the windings B and F is also illustrated. When this vector is summed with the vector 1 produced by the secondary winding S1, the vector 1", which in the illustrated embodiment is equivalent to the vector 1', is developed. The operation of this embodiment is shown in FIG. 3C as reflected to the primary. As can be seen, the primary phase 1 now has a load vector indicated as 1". It is specifically noted that this vector 1" is shorter than the vector 1' as shown in FIG. 3B. This is because of the presence of vectors 2" and 3" in FIG. 3C which are the result of the components and load developed by windings B and F respectively.

The summing of the –B and –F vectors with the vector 1 is developed essentially based on a current sharing relationship. To this end it is preferably desirable for optimal load balancing that the resistance of the combined coupled windings B and F be approximately equal to the secondary winding S1 and further that the voltage developed by the combined coupled windings B and F be equal to or slightly greater than voltage developed by the secondary winding S1. Given the resistance requirements, it is then clear that larger gauge wire must be utilized in the coupled windings C1 and C2 to meet the desired resistance goals to improve efficiency of load balancing while at the same time meeting the desired voltage requirements. In an ideal case where the resistances of the coupled windings and the secondary winding are equal, the unbalanced portion of the secondary load is split equally between the secondary winding S1 and the coupled windings, in this example windings B and F. Thus, up to 50% of the imbalance is handled by secondary winding S1, in a theoretical maximum case, and 50% of the imbalance is split between the windings B and F because of their series nature. When these currents are reflected back to the primary of the transformers T1, T2 and T3, there has been a theoretical 50% reduction in the imbalance of the primary phase 1, with 25% increases in the current provided by the primary phases 2 and 3, thus resulting in an overall significantly more balanced condition.

However, it is noted that the current provided by the primary phases 2 and 3 includes a reactive component because of the nature of the configuration. While this reactive power is a disadvantage to the transformer design according to the present invention, the passive load balancing capabilities are deemed to greatly outweigh this disadvantage in the whole. Further, the reactive power can be readily absorbed using relatively conventional techniques. For instance, the reactive power in the lagging phase, that is phase 2, is a capacitive load. In most distribution installations this is actually considered a help as generally many of the secondary loads have been developed as motors, which are lagging loads. Therefore, this capacitive power is often considered helpful in counteracting the inductive load of the motors. In terms of the leading phase, that is phase 3, this is an inductive load. As conventionally handled, inductive reactance can be handled by switched capacitor banks, which are significantly less expensive and less complicated than tap changing transformers. So that even with this disadvantage, the overall system complexity is still greatly reduced.

Figure 4:
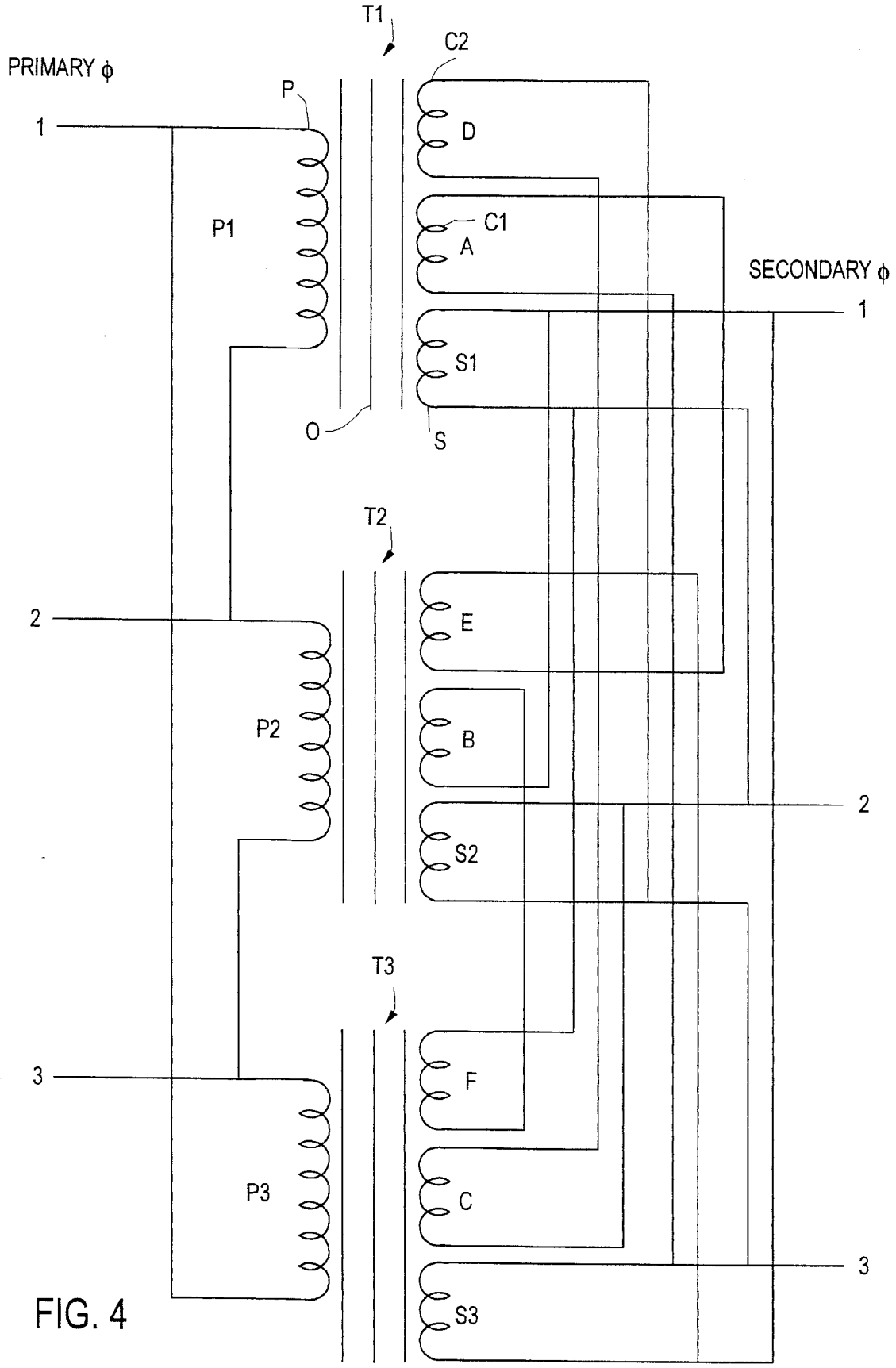
FIG. 4 is a schematic diagram of a three phase transformer arrangement according to the present invention in a Δ primary and secondary configuration.
Figure 5A:
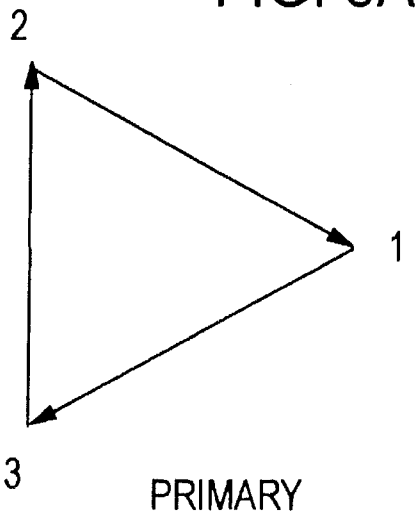
FIGS. 5A and 5B are vector diagrams of the transformers of FIG. 4.
Figure 5B:
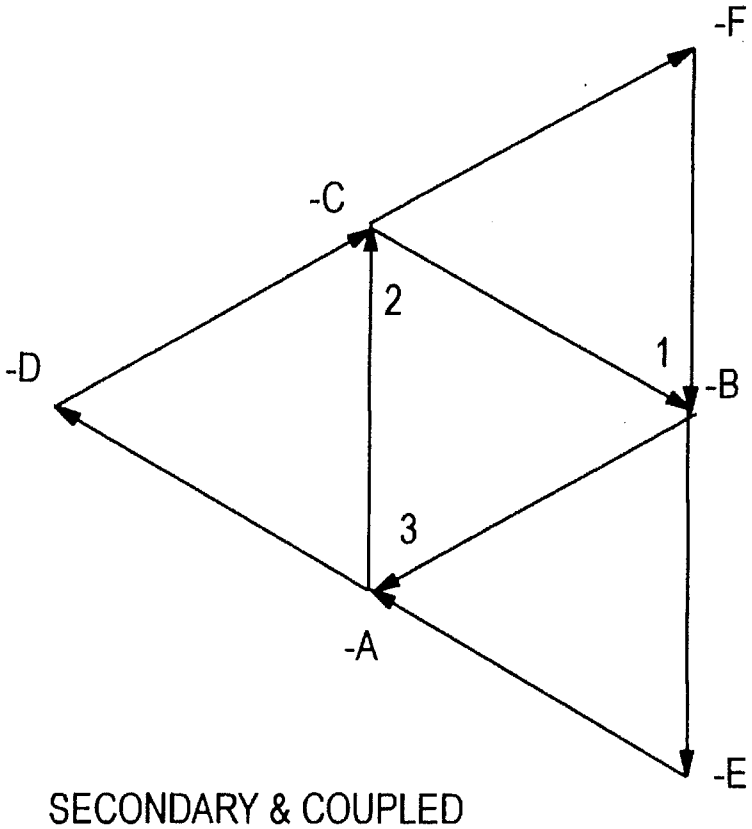

FIG. 4 illustrates the transformers T1, T2 and T3 configured in a Δ primary and Δ secondary arrangement. As can be seen, the coupled windings C1 and C2 from two phases are connected in negative series and in parallel with the third phase, as in the Y connections of FIG. 1, so that load balancing occurs. FIGS. 5A and 5B are the vector illustrations of the transformers T1, T2 and T3 when connected as shown in FIG. 4.

One skilled in the art will readily appreciate that other arrangements, such as Y primary and Δ secondary or Δ primary and Y secondary, can also be developed if needed.

Prototypes of the transformers connected according to FIG. 1 have been developed. Particular transformers have been developed having an input voltage of 115 V and an output voltage of 18 V, with the basic turns ratio between the primary winding P and the secondary winding S and the coupled windings C1 and C2 being 6.39. These lower voltages were utilized to simply testing, with the transformer operating similarly at conventional distribution and transmission voltages. The resistances of the secondary windings S and each of the coupled windings C1 and C2 was equal for simplicity of the prototype. Tests with these particular transformers have indicated that between 25 and 33% of the unbalanced load is transferred to the two more lightly loaded phases. This lower imbalance transfer percentage from ideal is in major part due to the resistances of each of the coupled windings and the secondary winding being equal. If the resistances were closer to ideal, namely the resistance of each coupled winding being one-half of the resistance of the secondary winding, the imbalance transfer would have been much closer to the ideal 50%. Further gains could also have been accomplished by better magnetic coupling.

During the tests it was also determined that a transformer according to FIG. 1 also reduced the harmonics in the heavily loaded phase. A non-linear or heavily electronic, load was utilized in performing certain of the tests. Upon measurement, it was determined that effectively an equal amount of harmonics were transferred to the lightly loaded phases, effectively parallelling the proportion of the load being transferred. Thus, not only does the transformer design balance loads but it also balances harmonics by shifting the harmonics between the various phases.

This is further done in a transformer which is passive and thus more simple to maintain and less prone to failure than a tap changer mechanism or active component. Further, it is not sufficiently complex to greatly increase the cost of the transformer and provides the added benefits of harmonic balancing.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

I claim:

1. A three phase transformer for connection to a three phase primary and for providing a three phase secondary, the transformer comprising:

first, second and third primary phases;

first, second and third secondary phases;

a first phase transformer core;

a first primary winding wound about said first phase transformer core and connected to said first primary phase;

a first secondary winding wound about said first phase transformer core and connected to said first secondary phase;

a first coupled winding wound about said first phase transformer core;

a second coupled winding wound about said first phase transformer core;

a second primary winding wound about said second phase transformer core and connected to said second primary phase;

a second secondary winding wound about said second phase transformer core and connected to said second secondary phase;

a third coupled winding wound about said second phase transformer core;

a fourth coupled winding wound about said second phase transformer core;

a third primary winding wound about said third phase transformer core and connected to said third primary phase;

a third secondary winding wound about said third phase transformer core and connected to said third secondary phase;

a fifth coupled winding wound about said third phase transformer core; and a sixth coupled winding wound about said third phase transformer core, wherein said first coupled winding and said third coupled winding are connected in negative series and in parallel with said third secondary winding, wherein said second coupled winding and said fifth coupled winding are connected in negative series and in parallel with said second secondary winding, and wherein said fourth coupled winding and said sixth coupled winding are connected in negative series and in parallel with said first secondary winding.

2. The transformer of claim 1, wherein the voltage of said negative series connections of said coupled windings is approximately equal to the voltage of said secondary winding in parallel with said coupled windings.

3. The transformer of claim 1, wherein the series resistance of said negative series connections of said coupled windings is approximately equal to the resistance of said secondary winding in parallel with said coupled windings.

4. The transformer of claim 3, wherein the voltage of said negative series connections of said coupled windings is approximately equal to the voltage of said secondary winding in parallel with said coupled windings.

5. The transformer of claim 1, wherein said first phase transformer core, said first primary winding, said first secondary winding, said first coupled winding and said second coupled winding are formed as a single phase transformer, wherein said second phase transformer core, said second primary winding, said second secondary winding, said third coupled winding and said fourth coupled winding are formed as a single phase transformer, and wherein said third phase transformer core, said third primary winding, said third secondary winding, said fifth coupled winding and said sixth coupled winding are formed as a single phase transformer.

6. The transformer of claim 1, wherein said first, second and third primary windings are connected in a Y configuration.

7. The transformer of claim 6, wherein said first, second and third secondary windings are connected in a Y configuration.

8. The transformer of claim 1, wherein said first, second and third primary windings are connected in a Δ configuration.

9. The transformer of claim 8, wherein said first, second and third secondary windings are connected in a Δ configuration.

10. A three phase transformer for connection to a three phase primary and for providing a three phase secondary, the transformer comprising:

three primary phases;

three secondary phases;

three transformer portions, each portion including:

a transformer core;

a primary winding wound about said transformer core;

a secondary winding wound about said transformer core; and two coupled windings each wound about said transformer core;

wherein each primary winding is connected to a different one of said primary phases, wherein each secondary winding is connected to a different one of said secondary phases, and wherein one coupled winding from a first of said portions and one coupled winding from a second of said portions are connected in negative series and in parallel with said secondary winding of the third of said portions for each of said secondary phases.

11. The transformer of claim 10, wherein the voltage of said negative series connections of said coupled windings is approximately equal to the voltage of said secondary winding in parallel with said coupled windings.

12. The transformer of claim 10, wherein the series resistance of said negative series connections of said coupled windings is approximately equal to the resistance of said secondary winding in parallel with said coupled windings.

13. The transformer of claim 12, wherein the voltage of said negative series connections of said coupled windings is approximately equal to the voltage of said secondary winding in parallel with said coupled windings.

14. The transformer of claim 10, wherein each of said transformer portions is formed as a single phase transformer.

15. The transformer of claim 10, wherein said three primary windings are connected in a Y configuration.

16. The transformer of claim 15, wherein said three secondary windings are connected in a Y configuration.

17. The transformer of claim 10, wherein said three primary windings are connected in a Δ configuration.

18. The transformer of claim 17, wherein said three secondary windings are connected in a Δ configuration.

* * * * *